United States Patent [19]

Jenkins

[11] Patent Number: 5,022,886

[45] Date of Patent: Jun. 11, 1991

[54] TOY DOLL AND ACCESSORIES THEREFOR

[75] Inventor: Barbara P. Jenkins, Providence, R.I.

[73] Assignee: Hasbro, Inc., Pawtucket, R.I.

[21] Appl. No.: 475,845

[22] Filed: Feb. 6, 1990

[51] Int. Cl.[5] ..... A63H 3/00; A63H 3/08; A63H 33/00

[52] U.S. Cl. ..... 446/268; 446/98; 446/313; 446/489

[58] Field of Search ..... 446/98, 97, 99, 100, 446/268, 313, 28, 487, 489, 491

[56] References Cited

U.S. PATENT DOCUMENTS

| | | | |
|---|---|---|---|
| D. 195,069 | 4/1963 | Zuckerman | D6/316 |
| 526,901 | 10/1894 | Hoyt | 446/98 |
| 1,621,231 | 3/1927 | Basinger | 446/98 |
| 2,028,120 | 1/1936 | Campbell | 446/98 |
| 2,045,830 | 6/1936 | Brundage | 446/98 |
| 2,193,447 | 3/1940 | Chloupek | 446/98 |
| 2,384,330 | 9/1945 | Muggy et al. | 446/98 |
| 2,944,368 | 7/1960 | O'Brian et al. | 446/98 |
| 3,073,059 | 1/1963 | Doyle et al. | 446/98 |
| 3,075,677 | 1/1963 | Meisenberg | 223/68 |
| 3,075,677 | 1/1963 | Meisenberg | 446/268 X |
| 3,102,360 | 9/1963 | Doyle et al. | 446/98 |
| 3,252,243 | 5/1966 | Doyle et al. | 446/98 |
| 3,412,998 | 11/1968 | Lott et al. | 446/268 X |
| 3,592,469 | 7/1971 | Glass | 273/1 R |
| 3,646,705 | 3/1972 | Nicholson | 446/98 |
| 3,668,805 | 6/1972 | Coleman | 446/98 |
| 3,939,604 | 2/1976 | Nishizawa | 446/98 |
| 4,041,638 | 8/1977 | Knibbs | 446/313 |
| 4,044,498 | 8/1977 | Rahmstorf | 446/313 |
| 4,122,628 | 10/1978 | Crowell et al. | 446/98 |
| 4,227,340 | 10/1980 | Goldfarb et al. | 446/100 |
| 4,344,249 | 8/1982 | Goldfarb et al. | 446/101 |
| 4,414,774 | 11/1983 | Fogarty et al. | 446/98 |
| 4,805,816 | 2/1989 | Freund | 223/66 |
| 4,911,670 | 3/1990 | McNicholas et al. | 446/74 |

*Primary Examiner*—Robert A. Hafer
*Assistant Examiner*—D. Neal Muir
*Attorney, Agent, or Firm*—Salter & Michaelson

[57] ABSTRACT

A toy doll includes a substantially flat, rigid, free standing main body member and a substantially rigid clothing member which is detachably securable to the main body member to provide a simulated suit of clothing therefor. The clothing member includes a substantially flat front plate portion of substantially the same peripheral configuration as a portion of the main body member and a peripheral flange portion which is engageable with the side surfaces of the main body member for securing the clothing member thereto. The doll can be effectively utilized in combination with an animal member accessory by assembling the doll on the back of the animal member and the clothing member can be disassembled from the body member and assembled on a simulated clothing rack accessory.

7 Claims, 2 Drawing Sheets

TOY DOLL AND ACCESSORIES THEREFOR

BACKGROUND AND SUMMARY OF THE INVENTION

The instant invention relates to toy dolls and more particularly to a unique and simple toy doll comprising a substantially rigid body member and a substantially rigid, detachable clothing member and to animal and clothing rack accessories for the doll.

Despite the availability of a wide variety of relatively complex life-like dolls it has been found that relatively simple toy dolls continue to have a high degree of popularity with young children. In addition, it has been found that relatively simple dolls which can be readily adapted for use in various different play settings often have particularly high levels of popularity. Still further, it has been found that dolls or portions thereof which are adapted to be assembled with various toy accessories have relatively high levels of popularity among children. However, it has also been found that in most instances the heretofore available relatively simple dolls have not been readily adaptable for use in various different play settings and they have not been adapted to be assembled with various toy accessories.

Doll constructions and similar articles representing the closest prior art to the subject invention of which the applicant is aware are disclosed in the U.S. patents to Hoyt, No. 526,901; Basinger, No. 1,621,231; Campbell, No. 2,028,120; Brundage, No. 2,045,830; Chloupek, No. 2,193,447; Meisenberg, No. 3,075,677; Muggy et al, No. 2,384,330; O'Brian et al, No. 2,944,368; Doyle et al, No. 3,073,059; Doyle et al, No. 3,102,360; Doyle et al, No. 3,252,243; Glass, No. 3,592,469; Nicholson, No. 3,646,705; Coleman, No. 3,668,805; Nishizawa, No. 3,939,604; Crowell et al, No. 4,122,628; Goldfarb et al, No. 4,227,340; Freund, No. 4,805,816; and Zuckerman, No. D-195,069. Of these references, the U.S. patent to Goldfarb et al, No. 4,227,340 is believed to be the most closely related to the doll construction of the subject invention. However, even this reference fails to disclose or suggest a doll construction comprising clothing and body members of the type included in the doll construction of the instant invention and hence the above references are believed to be of only general interest with respect to the subject invention.

The toy doll of the instant invention comprises a substantially rigid free standing body member including a front surface portion and a rearwardly extending peripheral side surface portion and a substantially rigid clothing member including a front plate portion and a rearwardly extending peripheral flange portion. The clothing member is constructed so that it is receivable in engagement on the body member with the front plate portion of the clothing member in substantially aligned relation with the front surface portion and so that the flange portion engages the side surface portion to releasably retain the clothing member on the body member. The front and rear surface portions of the body member are preferably substantially parallel and substantially flat and the front plate portion of the clothing member is preferably also substantially flat. The clothing member is preferably constructed so that it is receivable on the body member so that the front plate portion of the clothing member is in closely spaced substantially parallel relation to the front surface portion of the body member and the body member preferably includes a pair of enlarged foot portions which are operative for supporting the body member and the clothing member in free standing relation on a supporting surface. The doll preferably further comprises fulcrum means on either the rear side of the clothing member or the front side of the body member and the clothing member is preferably constructed so that it is pivotable about the fulcrum means for moving a portion of the clothing member outwardly away from the front surface portion of the body member so that the clothing member can be more easily disassembled from the body member.

The doll of the instant invention is preferably adapted for use in combination with one or more accessories, such as an animal member and a clothing rack. When the doll is adapted for use in combination with an animal member, the body member and the clothing member each include a pair of diverging leg portions and the body member preferably includes a pair of enlarged foot portions which extend inwardly and together slightly from their respective leg portions. The doll member is preferably adapted for use in combination with a four legged variety of animal member including a body section having a back portion and at least two leg portions and the doll member is adapted so that it is receivable on the back portion of the animal member. Further, the animal member preferably includes rib means on each side of the body section and the doll member is constructed so that the foot portions thereof are snap receivable in engagement with the rib means for retaining the doll member on the animal member.

The doll of the subject invention is preferably also adapted for use in combination with a clothing rack and in this case the body member and the clothing member preferably each include a pair of outwardly extending arm portions which define open slots between the arm portions and the torso portion of the doll. The clothing rack accessory preferably includes a main wall portion, means for supporting the main wall portion in a substantially vertical disposition on a supporting surface and means receivable in the open slots between the arm portions and the torso portion of the clothing member for releasably retaining the clothing member on the main wall portion of the clothing rack. When the doll is adapted for use in combination with a clothing rack, the front plate portion of the clothing member preferably has a notch formed in the collar area of the clothing portion and the rack preferably further includes means which is engagable with the front plate portion of the clothing member in the collar notch for further releasably retaining the clothing member on the main wall portion.

It has been found that the doll construction of the instant invention has a significant level of play value whether used alone or in combination with the accessories of the subject invention. Specifically, it has been found that the overall simplicity of the toy doll of the subject invention has significant appeal both from the standpoint of providing a high level of play value and from a cost standpoint. It has been further found that the basically flat construction of the doll of the subject invention enhances the play value thereof by providing a simple yet interesting basic character form. Further, the manner in which the clothing member can be readily detached from the doll member and replaced with a different clothing member and the manner in which the doll can be utilized in combination with the animal and clothing rack accessories enable the doll of the subject invention to be readily adapted for use in a wide variety of play themes and settings.

Accordingly, it is a primary object of the instant invention to provide an effective doll construction comprising a substantially flat rigid body member and a rigid clothing member which is snap receivable in engagement with the body member.

Another object of the instant invention is to provide a relatively simple but appealing toy doll which can be readily adapted for use in various different play settings and themes.

Another object of the instant invention is to provide a toy doll comprising a body member and a clothing member which can be effectively utilized in combination with an animal member accessory and/or a clothing rack accessory.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 3:
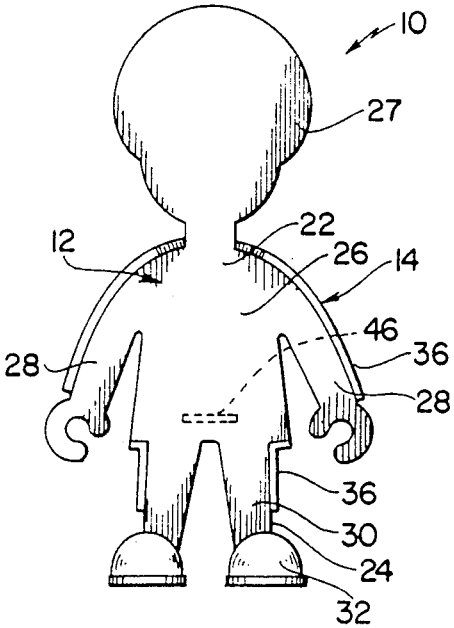
FIG. 3 is a rear elevational view of the doll.
Figure 4:
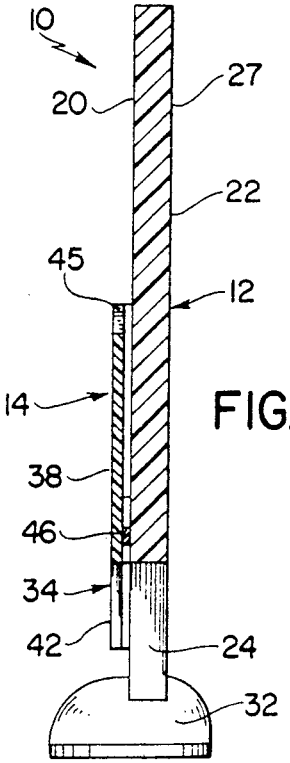
FIG. 4 is an enlarged sectional view taken along line 4—4 in FIG. 1.
Figure 5:
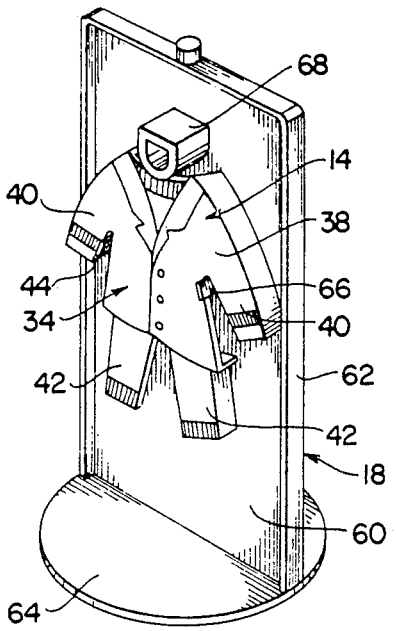
FIG. 5 is a perspective view of the clothing member of the doll in combination with a clothing rack accessory.
Figure 6:
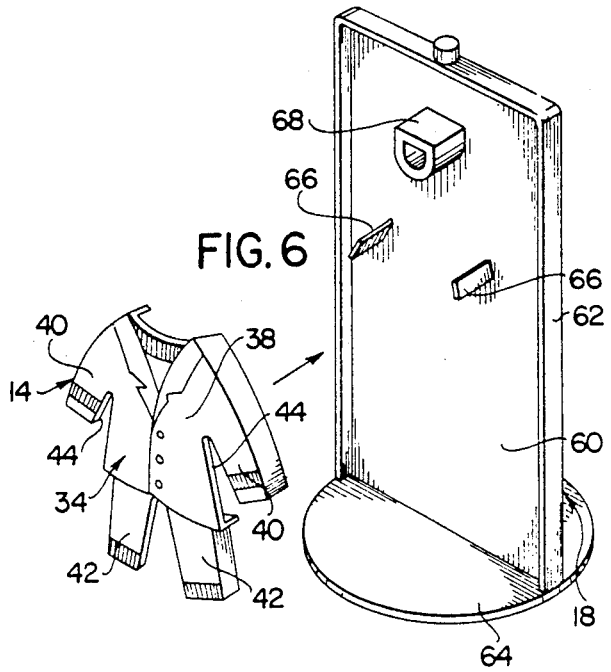
FIG. 6 is an exploded perspective view thereof.
Figure 7:
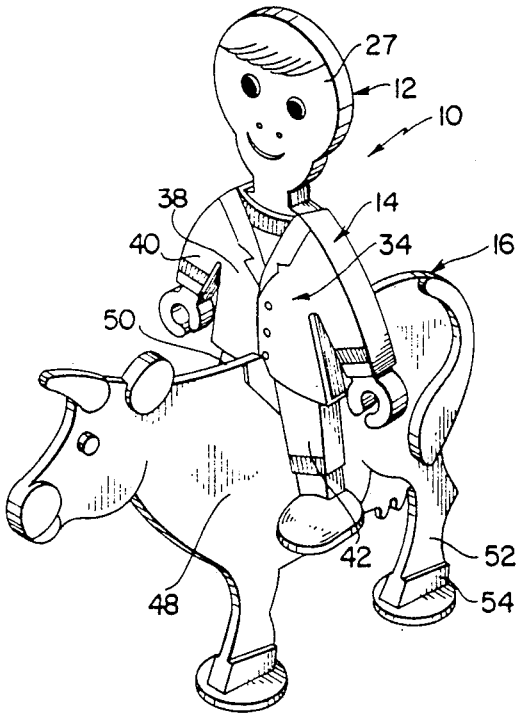
FIG. 7 is a perspective view of the doll in combination with an animal member accessory.
Figure 8:
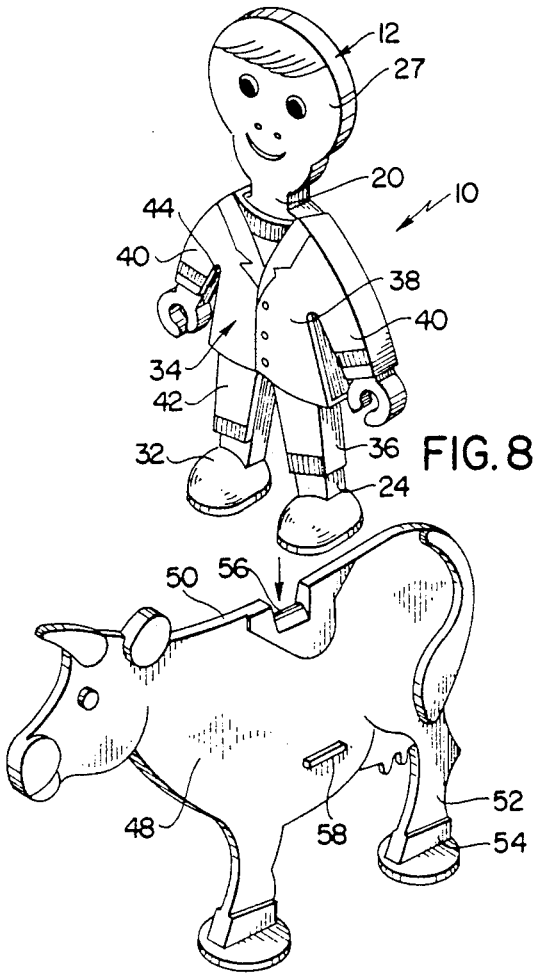
FIG. 8 is a partially exploded perspective view thereof.

Referring now to the drawings, the toy doll of the instant invention is illustrated and generally indicated at 10 in FIGS. 1–4, 7 and 8. As illustrated in FIGS. 1–4, the toy doll 10 comprises a free standing body member generally indicated at 12 and a clothing member generally indicated at 14 which is releasably securable in engagement with the body member 12. As illustrated in FIGS. 7 and 8, the doll 10 can be effectively assembled with an animal accessory generally indicated at 16, and as illustrated in FIGS. 5 and 6, the doll 10 can be effectively utilized in combination with a clothing rack accessory generally indicated at 18 by assembling the clothing member 14 on the clothing rack accessory 18.

Figure 2:
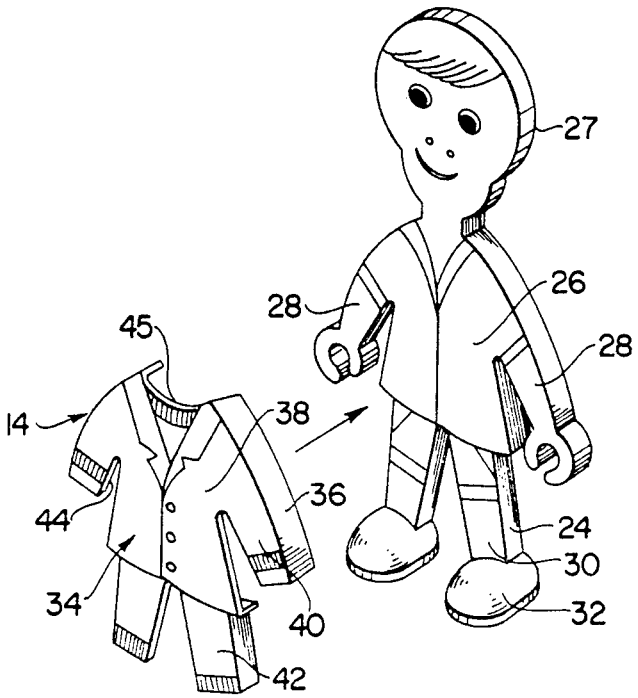
FIG. 2 is an exploded perspective view thereof.

The body member 12 is preferably integrally molded from a suitable plastic material and it includes relatively closely spaced substantially flat, substantially parallel front and rear surfaces 20 and 22, respectively, and a side surface 24 which extends substantially perpendicularly between the front and rear surfaces 20 and 22, respectively. The body member 12 is formed in a configuration which resembles a human silhouette, although it will be understood that the character figure embodied in the body member 12 could alternatively be another type of character figure, such as an animal character figure. In any event, the body member 12 as herein embodied includes a torso portion 26, a head portion 27, a pair of outwardly extending arm portions 28, a pair of diverging leg portions 30 and a pair of enlarged foot portions 32. The foot portions 32 are preferably of generally rounded configuration and they are adapted for supporting the body member 12 in free standing relation on a supporting surface. The foot portions 32 are further formed so that they project inwardly and together slightly from their respective leg portions 30 as illustrated most clearly in FIG. 3. As illustrated in FIG. 2, the head portion 27 is adapted to include various facial markings, whereas the torso portion 26, the arm portions 28, the leg portions 30 and the foot portions 32 are preferably adapted to include suitable markings which resemble various portions of a human body as well as various articles of clothing worn thereon.

Figure 1:
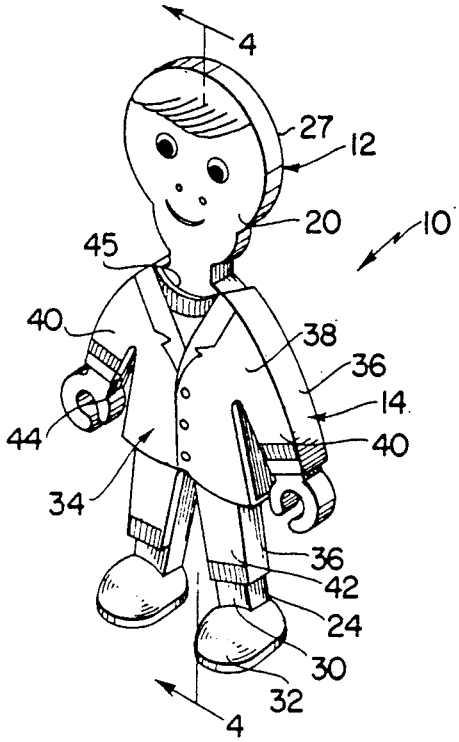
FIG. 1 is a perspective view of the toy doll of the subject invention.

The clothing member 14 preferably includes a substantially flat front plate portion generally indicated at 34 and a rearwardly extending peripheral flange portion 36. The front plate portion 34 preferably has a peripheral configuration which is substantially the same as the peripheral configuration of at least half of the body portion 12. The plate portion 34 preferably includes a torso portion 38, a pair of outwardly extending arm portions 40 and a pair of diverging leg portions 42. Open notches 44 are preferably formed between the arm portions 40 and the torso portion 38 and a slightly rounded collar notch or edge 45 is formed in the collar area of the torso portion 38. The plate portion 34 is preferably of slightly greater dimension then the corresponding portion of the body portion 12 and the flange portion 36 extends substantially perpendicularly rearwardly from the front plate portion 34 so that it is frictionally engagable with the side surface 24 of the body member 12 for retaining the clothing member 14 thereon. In this regard, the flange portion 36 is preferably constructed so that when the clothing member 14 is assembled on the body member 12, the flange portion 36 extends rearwardly along at least approximately 50% of the perimeter of the plate portion 34 so that the flange portion 36 covers most of the exposed portions of the side surface 24. The clothing member 14 is preferably adapted to include various markings which impart the appearance of a suit of outer garments to the clothing member 14 as illustrated in FIGS. 1 and 2. As illustrated in FIGS. 3 and 4, the clothing member 14 preferably further includes a fulcrum element 46 which extends rearwardly from the lower portion of the torso portion 38 for engaging the front surface 26 of the body member 12. The fulcrum element 46, which could alternatively be formed on the front surface portion 26, is operative for facilitating the removal of the clothing member 14 from the body member 12. Specifically, the fulcrum element 46 is operative by pressing either the upper or lower portion of the clothing member 14 inwardly toward the body member 12 to pivot the opposite portion of the clothing member 14 outwardly from the body member 12 so that the outwardly pivoted portion of the clothing member 14 can be more easily grasped to facilitate the disassembly of the clothing member 14 from the body member 12.

Referring now to FIGS. 7 and 8, the animal accessory 16 is preferably also substantially flat and it includes a body section 48 having a back portion 50, a pair of leg portions 52, each of which defines two legs of the animal embodied in the animal accessory 16, and a pair of hoof portions 54. A notch 56 is formed in the back 50 and a substantially horizontally disposed rib 58 is provided on each side of the body section 48. The animal accessory 16 is adapted to be supported on the hooves 54 so that the animal accessory 16 is receivable in free standing relation on a supporting surface. The doll 10 is receivable on the back portion 50 of the animal accessory 16 in the manner illustrated in FIGS. 7 and 8. Specifically, the doll 10 is receivable on the back portion 50 so that the foot portions 32 are received in engagement with the ribs 58 on opposite sides of the body section 48 for releasably retaining the doll 10 on the animal accessory 16. The animal accessory 16 is further adapted for receiving the doll 10 thereon so that the doll 10 is received in the notch 56 in the back 50 as illustrated.

Referring now to FIGS. 5 and 6, the clothing rack accessory 18 comprises a main wall 60 having a peripheral frame 62 thereon, and a base 64 which is operative for supporting the main wall 60 in a substantially vertical disposition. The rack 18 further comprises a pair of spaced tabs 66 and a projection 68 which extends outwardly from the main wall 60. The tabs 66 and the projection 68 are configured and positioned to be received in engagement with the clothing member 14 in the manner illustrated in FIG. 6. Specifically, the tabs 66 are adapted so that they are receivable in the slots 44 between the arm portions 40 and the torso portion 38 and the projection 68 is adapted so that it is frictionally engagable with the collar edge 45 for releasably retaining the clothing member 14 on the clothing rack 18.

Accordingly, for use of the doll 10, the body member 12 can be effectively utilized alone or in combination with the clothing member 14 and the clothing member 14 can be effectively assembled with the body member 12 for altering the outer appearance of the doll 10 by providing a simulated new suit of outer clothing therefor. However, when the clothing member 14 is disassembled from the body member 12 it can be effectively stored on the clothing rack 18. Further, the body member, with or without the clothing member 14 assembled thereon, can be effectively assembled on the animal accessory 16 when desired to add a new dimension to the play format for the doll 10. In any case, the unique and simple construction of the doll 10 makes it highly attractive and adapted for a wide variety of play themes. Further, the basically simple construction of the doll 10 makes is readily adapted for a variety of relatively inexpensive constructions. Accordingly, it is seen that the doll of the instant invention and the accessories therefor represent significant advancements in the toy art which have significant commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A doll construction comprising a substantially rigid body member including a front surface portion and a peripheral side surface portion, said front surface portion having a peripheral configuration resembling a silhouette of a character figure, said side surface portion extending substantially perpendicularly rearwardly from said front surface portion along substantially the entire periphery of said front surface portion, and a substantially rigid clothing member including a front plate portion and a peripheral flange portion extending rearwardly from said front plate portion, said front plate portion having a peripheral configuration which is substantially the same as the peripheral configuration of a portion of said front surface portion but being of slightly larger dimension than said portion of said front surface portion, said clothing member being receivable in an assembled relation with said body member wherein said front plate portion is received in substantially aligned closely adjacent relation on said portion of said front surface portion, said flange portion engaging said side surface portion to releasably retain said clothing member on said body member when said clothing member is received in assembled relation on said body member, said doll further comprising fulcrum means on one of either said body member or said clothing member, said fulcrum means being interposed between said front surface portion and a central portion of said front plate portion when said clothing member is received in assembled relation on said body member, said clothing member being removable from said body member by pressing a portion of said clothing member inwardly toward said body member to pivot said clothing member about said fulcrum means and to thereby move a portion of clothing member outwardly away from said body member.

2. In the doll construction of claim 1, said character figure further characterized as a human character figure.

3. A doll construction comprising a substantially rigid body member including a substantially flat front surface portion and a peripheral side surface portion, said front surface portion having a peripheral configuration resembling a silhouette of a character figure, said side surface portion extending substantially perpendicularly rearwardly from said front surface portion along substantially the entire periphery of said front surface portion, and a substantially rigid clothing member including a substantially flat front plate portion and a peripheral flange portion extending rearwardly from said front plate portion, said front plate portion having a peripheral configuration which is substantially the same as the peripheral configuration of a portion of said front surface portion but being of slightly larger dimension than said portion of said front surface portion, said clothing member being receivable in an assembled relation with said body member wherein said front plate portion is received in substantially aligned closely adjacent substantially parallel relation on said portion of said front surface portion, said flange portion engaging said side surface portion to releasably retain said clothing member on said body member when said clothing member is received in assembled relation on said body member, said doll further comprising fulcrum means on one of either said body member or said clothing member, said fulcrum means being interposed between said front surface portion and a central portion of said front plate portion when said clothing member is received in assembled relation on said body member, said clothing member being removable from said body member by pressing a portion of said clothing member inwardly toward said body member to pivot said clothing member about said fulcrum means and to thereby move a portion of clothing member outwardly away from said body member.

4. In combination, a doll and an animal member. said doll comprising a substantially rigid body member including a front surface portion and a peripheral side surface portion, said front surface portion having a peripheral configuration resembling a silhouette of a human body, said side surface portion extending substantially perpendicular rearwardly from said front surface portion along substantially the entire periphery of said front surface portion, and a clothing member including a front plate portion and a peripheral flange portion extending rearwardly from said front plate portion, said front plate portion having a peripheral configuration which is substantially the same as the peripheral configuration of a portion of said front surface portion but being of slightly larger dimension than said portion of said front surface portion, said body member including a pair of diverging leg portions and a pair of spaced enlarged foot portions on said leg portions, said foot portions extending inwardly and together slightly from their respective leg portions, said foot portions being receivable on a supporting surface for supporting said body member in free standing relation thereon, said clothing member being receivable in an assembled relation on said body member wherein said front plate portion is received in substantially aligned relation on said portion of said front surface portion, said flange portion engaging said side surface portion to releasably retain said clothing member on said body member when said clothing member is received in assembled relation on said body member, said animal member including a substantially flat main portion including a substantially horizontal body section having a back portion, at least two leg sections depending from said body section and at least two enlarged hoof portions, said hoof portions being operative for supporting said animal in free standing relation on a supporting surface, said animal member further comprising rib means on each side thereof said doll being receivable on the back portion of said animal member so that said foot portions are snap received in engagement with said rib means for retaining said doll on said animal member.

5. In the doll construction of claim 4, said front surface portion and said front plate portion being substantially flat.

6. In combination, a doll and a clothing rack, said doll including a substantially rigid body member including a front surface portion and a peripheral side surface portion said front surface portion having a peripheral configuration resembling a silhouette of a human body, said side surface portion extending substantially perpendicularly rearwardly from said front surface portion portion along substantially the entire periphery of said front surface portion, and a clothing member including a front plate portion and a flange portion extending substantially perpendicularly rearwardly from said front plate portion, said front plate portion having a peripheral configuration which is substantially the same as the peripheral configuration of a portion of said front surface portion but of slightly greater dimension than said portion of said front surface portion, said body member including a torso portion, a pair of outwardly extending arm portions which define open slots between said body member torso portion and said body member arm portions, and a pair of diverging leg portions, said clothing member also including a torso portion, a pair of outwardly extending arm portions which define open slots between said clothing member torso portion and said clothing member arm portions, and a pair of diverging leg portions, said body member being receivable in free standing relation on a supporting surface, said clothing member being receivable in an assembled relation on said body member wherein said front plate portion is received in substantially aligned relation on said portion of said front surface portion, said flange portion engaging said side surface portion to releasably retain said clothing member on said body member when said clothing member is received in assembled relation on said body member, said clothing rack including a main wall portion, means for supporting said main wall portion in a substantially vertical disposition on a supporting surface and means on said main wall portion receivable in said open slots for engaging said clothing member for alternatively releasably retaining said clothing member on main wall portion.

7. In the combination of claim 6, said front plate portion having a collar notch formed therein, said rack further comprising means on said main wall portion engageable with said front plate portion in said collar notch for further releasably retaining said clothing member on said main wall portion.

* * * * *